United States Patent [19]

White

[11] Patent Number: 4,749,310

[45] Date of Patent: Jun. 7, 1988

[54] MINE ROOF TRUSS

[75] Inventor: Claude C. White, Birmingham, Ala.

[73] Assignee: Birmingham Bolt Company, Inc., Birmingham, Ala.

[21] Appl. No.: 913,386

[22] Filed: Sep. 30, 1986

[51] Int. Cl.[4] ..... E21D 21/00

[52] U.S. Cl. ..... 405/288; 405/259

[58] Field of Search ..... 405/259, 288, 260, 261, 405/303

[56] References Cited

U.S. PATENT DOCUMENTS

| | | | |
|---|---|---|---|
| 3,505,824 | 4/1970 | White | 405/259 |
| 4,596,496 | 6/1986 | Tyrell et al. | 405/288 |
| 4,630,974 | 12/1986 | Sherman | 405/288 |

*Primary Examiner*—David H. Corbin

*Attorney, Agent, or Firm*—Shlesinger, Arkwright & Garvey

[57] ABSTRACT

A mine roof truss including opposed angularly disposed roof bolts, a horizontal truss member extending between the roof bolts, and couplings connecting the roof bolts to the truss member. Each coupling comprises a housing having walls forming a cavity into which the head of the roof bolt and an end of the truss member are inserted and secured. The end of the truss member is provided with a T-shaped head which is inserted through a slot in the housing wall leading to the cavity, following which the truss member is rotated relative to the housing to lock the truss member to the coupling. The roof bolt head and truss member are pivotally connected with the coupling to permit adjustments thereof when installed on an uneven roof surface.

11 Claims, 3 Drawing Sheets

MINE ROOF TRUSS

BACKGROUND OF THE INVENTION

For years, mine roof trusses have been used as a supplement to roof bolting in mining operations throughout the world, as illustrated and described in my previously granted U.S. Pat. Nos. 3,427,811, 3,505,824 and 3,509,726.

More recently, in order to reduce the time required for installing the roof trusses, a bolting machine employed for installation of the angular roof bolts installs the two opposed bolts of the truss, then quickly moves to another position to install another pair of bolts for the next truss. Workmen later install the horizontal truss member which must be connected to the roof bolts to complete the truss. This should be done as soon as possible in order to complete the truss structure promptly, since it is only after the horizontal truss member is installed and tensioned, that the full support of the truss is effective.

Up to the present time, the installation of the mine roof truss has been prolonged due to the time involved in installing the horizontal truss member, which conventionally must be joined by threaded connections, "U" bolts and other cumbersome means which is time consuming to install. Therefore, despite the fact that the roof bolting machines are capable of installing the angular bolts at a rapid rate, installation of the complete mine roof truss is slow because of the time required to connect the horizontal truss member to the roof bolts.

SUMMARY OF THE INVENTION

This invention relates to a mine roof truss comprising opposed angle roof bolts connected to a horizontal truss member by a coupling, wherein the components are assembled more easily and quickly in the mine roof truss than has heretofore been possible.

It is an object of this invention to provide a coupling for joining the angle bolts of a mine roof truss to the horizontal truss member thereof, wherein connection of the horizontal truss member to the coupling is effected by locking engagement of the end of the truss member with the coupling by a rotational movement of the truss member with respect to the coupling, thereby connecting the angle bolts and the horizontal truss member in a minimum of time and with a minimum of effort.

By eliminating threaded connections, "U" bolts and other cumbersome components which are time consuming to install, not only is the time of installation of the mine roof truss minimized, but the possibility of faulty installation is virtually eliminated, thereby affording greater protection from roof falls.

The coupling of the present invention is preferably of cast high strength ductile iron construction, the strength of which exceeds the strength of the angle bolt and the horizontal truss member. The coupling further is of minimum weight and has dimensions which provide maximum clearance under the truss for operation of mining machinery. A cast housing has walls forming a cavity into which the head of the angle bolt and the end of the horizontal truss member are inserted and anchored in close proximity within the cavity.

Locking engagement of the head of the horizontal truss member with the coupling is readily effected by providing a T-shape head at the end of the rod which is inserted through a slot in the coupling into the cavity of the housing, and, upon rotation of the truss member through an angle of approximately 90°, a connection of greater strength than the body of the truss member is achieved. Two horizontal rods comprise the horizontal truss member, which rods extend from opposite sides of the opening and can be quickly joined and tensioned by hydraulic tightening, turn buckles or other means.

The truss member and angle roof bolts are pivotally connected to the coupling to permit installation of the roof truss on an uneven surface of the mine roof.

DESCRIPTION OF THE PREFERRED EMBODIMENT OF THE INVENTION

Figure 1:
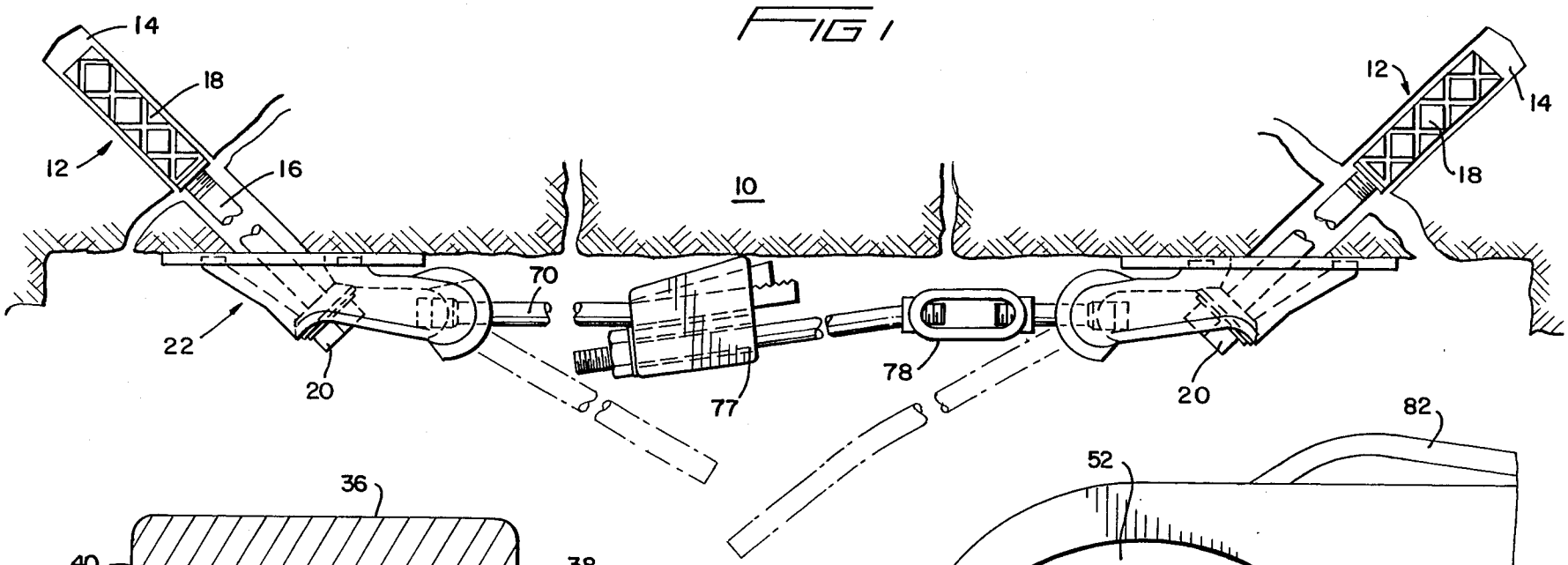
FIG. 1 is a plan view of a mine roof truss embodying the present invention, illustrating its application in an underground mine.
Figure 8:
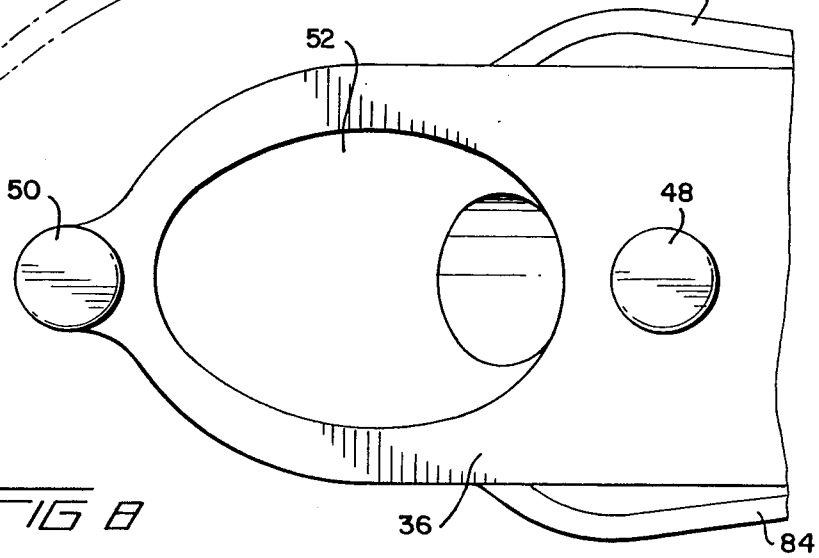
FIG. 8 is a fragmentary plan view of the housing illustrated in FIGS. 6 and 7.

The present invention is designed for the in cycle installation of a mine roof truss for supporting a mine roof 10. The truss generally includes a pair of angle roof bolts 12 of conventional construction which are installed in angularly disposed openings 14. Each roof bolt 12 includes a shank portion 16, the upper end of which is anchored to roof 10 adjacent opening 14 by an expansion shell 18 and/or resin in accordance with standard procedure. A head 20 extends from the lower end of shank 16. A coupling generally designated 22 is provided for connecting roof bolts 12 to a horizontal truss member 24.

Figure 2:
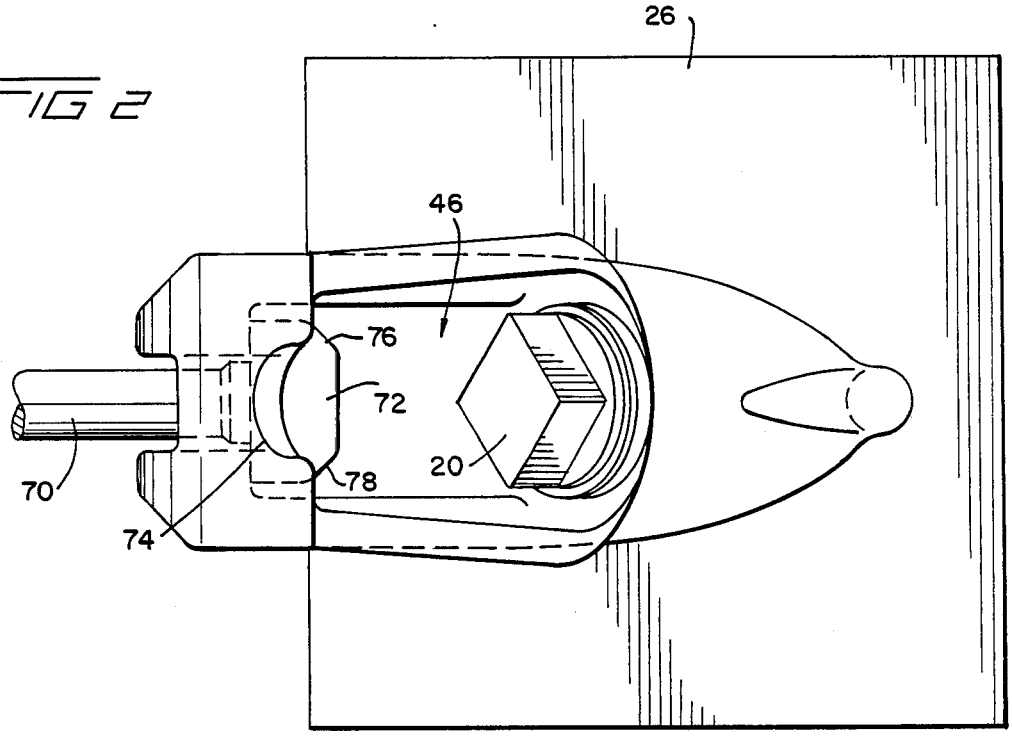
FIG. 2 is a plan view of the coupling of the present invention, illustrating its application.
Figure 4:
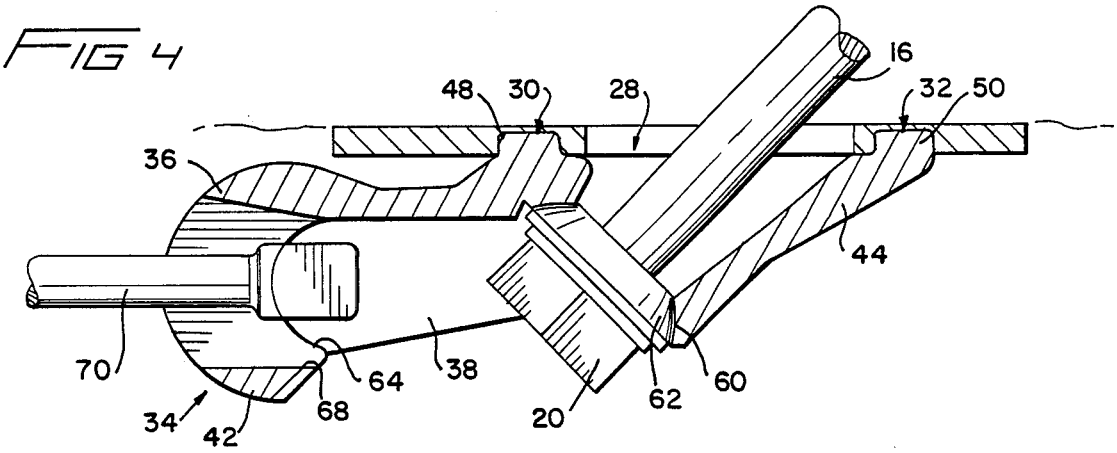
FIG. 4 is a sectional view taken along the line 4—4 of FIG. 3, looking in the direction of the arrows.
Figure 3:
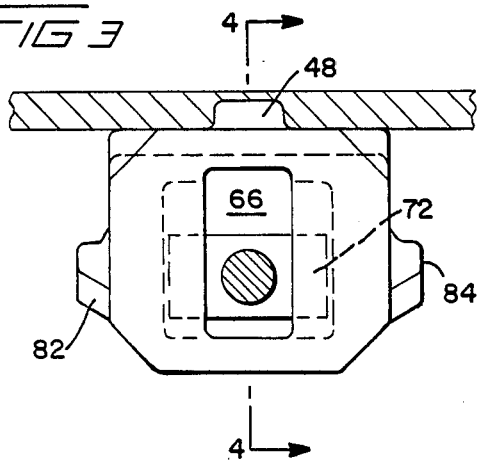
FIG. 3 is an end elevational view of the coupling of the present invention.

In accordance with the present invention, coupling 22 includes a roof plate 26 of flat rectangular construction, which is illustrated to advantage in FIGS. 2 and 4, the upper surface of plate 26 provides a bearing surface for engagement with the mine roof. As shown to advantage in FIGS. 2 and 4, plate 26 is provided with an enlarged central opening 28, and the lower surface of plate 26 is provided with a pair of spaced recesses 30 and 32 on opposite sides of opening 28, for purposes which will be hereinafter more fully set out.

Coupling 22 further includes a housing 34 which is preferably of cast high strength ductile iron construction, and comprises a top wall 36, side walls 38 and 40 and end walls 42 and 44, forming a cavity 46 therebetween.

The upper surface of top wall 36 is provided with a pair of spaced lugs 48 and 50 which complement, and are adapted to fit within, recesses 30 and 32 of top plate 26 in order to stabilize and position the housing with respect to the roof plate. Between lugs 48 and 50, top wall 36 is provided with an enlarged oval opening 52 which communicates with cavity 46 of the housing.

Figure 7:
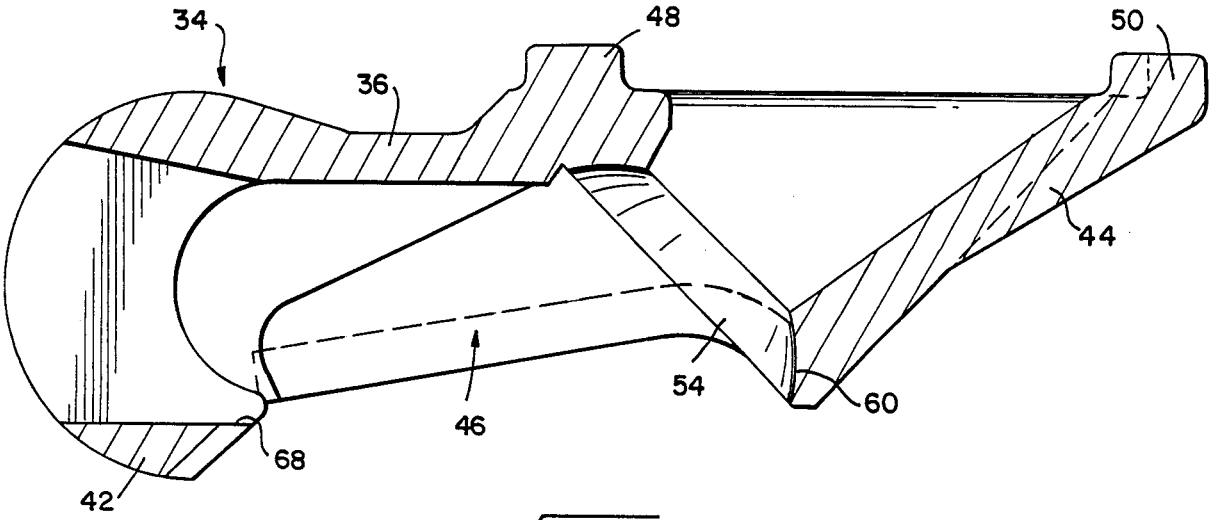
FIG. 7 is a sectional view taken along the line 7—7 of FIG. 6, looking in the direction of the arrows.
Figure 6:
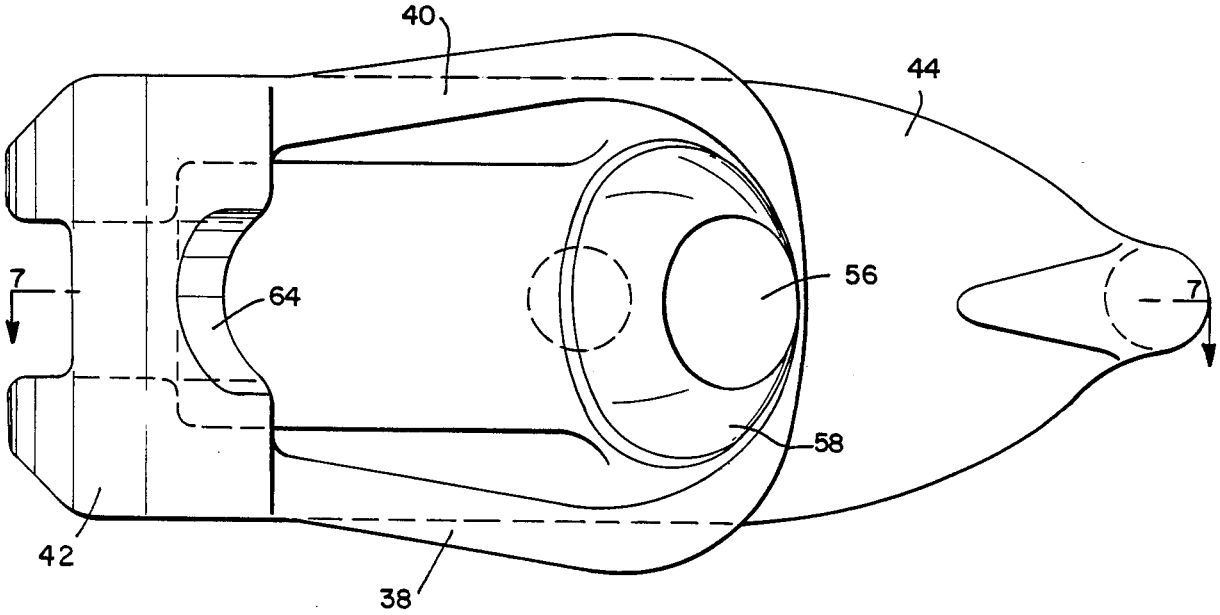
FIG. 6 is a plan view of a housing forming a part of the coupling of the present invention.

As shown to advantage in FIGS. 6 and 7, housing 34 is provided with a spherical seat 54 which extends transversely at an angle across cavity 46 between the end of top wall 36 which is adjacent opening 52 and the terminal of end wall 44 which is remote from lug 50. Spherical seat 54 is provided with a central opening 56 through which the shank 16 of bolt 12 extends, as shown to advantage in FIGS. 2 and 4. The lower surface of spherical seat 54 surrounding opening 56 is concave, as indicated at 58, for engagement with a complemental spherical washer 60 having a convex outer surface 62, which washer is positioned on bolt shank 16 adjacent head 20. Seat 54 and washer 60 provide pivotal engagement of the roof bolt and coupling to permit adjustment of the roof bolt when the truss is installed on an uneven roof surface.

End wall 42 of housing 34 is preferably of arcuate conformation, as shown to advantage in FIGS. 4 and 7, the inner concave surface of the wall being indicated at 64. End wall 42 is provided with a central elongated, vertical slot 66 of predetermined length and width, which slot terminates at a point spaced from the lower end of wall 64 to provide an abutment or stop 68.

Figure 5:
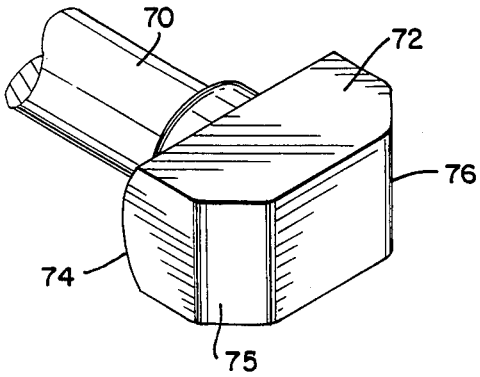
FIG. 5 is an enlarged perspective view of the T-shaped end of a truss member constructed in accordance with the present invention.

Horizontal truss member 24 includes a pair of like truss rods 70, one end of each of which is provided with a cross member 72 which extends beyond the periphery of rod 70, thereby forming a rod end of T-shape configuration, as shown in FIG. 5. The inner surface of cross member 72 is of uniform convex conformation, as indicated at 74, and the outer end thereof is beveled at 75 and 76 for ease of installation.

Cross member 72 is of generally polygonal shape in cross section, and the length thereof is slightly less than the length of slot 66 so that, when cross member 72 is oriented vertically, it may be inserted through elongated slot 66 in end wall 42 of housing 34. However, after insertion of cross member 72 through slot 66 of end wall 42, truss rod 70 may be rotated through a 90° angle to effect locking engagement of truss rod 70 with respecct to housing 34 to effect connection of the present coupling with the horizontal truss member.

As shown to advantage in FIGS. 4 and 5, when horizontal rod 70 is in locking engagement with coupling or housing 34, the inner convex surface 74 of cross member 72 is in contiguous engagement with the complemental concave surface 64 of wall 42. This enables horizontal rod 70 to be moved vertically with respect to housing 34 within the limits of longitudinal slot 66, as shown to advantage in dotted lines in FIG. 1. As therein indicated, before the opposed rods 70 of the truss member are connected, horizontal rods 70 will gravitate downwardly until they engage abutment or stop 68, thereby holding the ends of the two members in proximate relation, to facilitate connection thereof.

The proximate ends of truss rod 70 may be connected together, in any suitable manner such as by means of a wedge assembly 77 which may be similar to that disclosed in my previously granted U.S. Pat. No. 3,505,824. Tensioning of the horizontal truss member may be effected by a turnbuckle 78, hydraulic tightening, or other means.

Figure 9:
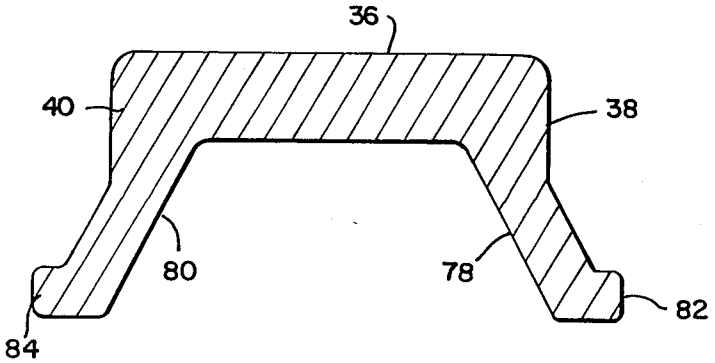
FIG. 9 is a sectional view taken along the line 9—9 of FIG. 7, looking in the direction of the arrows.

It will be further noted from a consideration of FIG. 9 of the drawing that side walls 38 and 40 are progressively angled outwardly from the top wall 36 thereof to the lower end of the housing, as indicated at 79 and 80, and that the lower edges of side walls 38 and 40 are flared outwardly to provide flanges 82 and 84. This arrangement facilitates the positioning of large power driven socket wrenches within cavity 46 for engagement with head 20 to install roof bolts.

In use of the mine truss of the present invention, angular openings are first drilled in the mine roof on opposite sides of the mine roof opening. Roof bolt 12, including spherical washer 60 is next connected with coupling 22 and the upper end of the roof bolt is driven upwardly into the opening by engagement of a large power driven socket wrench with bolt head 20 to anchor the upper end of the roof bolt securely in the mine roof. Spherical washer 60, engaged with complemental seat 58 automatically adjusts for variations in the angle at which the roof bolt extends through the coupling, caused by the unevenness of the roof surface.

In accordance with a salient feature of the present invention, the T-shape end of each rod 70 comprising truss member 24 is inserted through slot 66 of housing 34, following which they are rotated through a 90° angle to effect locking engagement of each rod with the housing.

By virtue of the arcuate conformation of end wall 42 of the housing, and the complemental convex surface 74 of cross piece 72, adjustment of each rod 70 in a vertical plane is possible. Additionally, as shown to advantage in FIG. 7, before the inner ends of rod 70 are connected together, they are free to gravitate downwardly and inwardly towards each other, and, as shown in dotted lines in FIG. 1, are held in this position by virtue of stop 68 which forms the lower limit of slot 66 of housing 34. The proximate ends of rods 70 may then be readily assembled together in a wedge assembly 77 or other suitable connecting means. Tensioning of the horizontal truss member may then be effected by means of a turnbuckle 78, hydraulic means, or other suitable equipment.

By means of the structural arrangement of the present mine roof truss, workmen may couple the horizontal truss member to the angle bolts rapidly and with less effort than has heretofore possible, the T-shape headed rods affording simple but effective locking means with the coupling when inserted into the cavity of the housing, and producing a connection of greater strength than that of the body of the rod. This arrangement further lessens possibility of faulty installation, and therefore affords greater protection from roof falls.

In practice the horizontal truss rod is initially installed with tension approximately equal to the yield point of its strength. Later, if the roof begins to settle, the stress in the rod and connection may increase to a figure equal to the ultimate strength of the rod or the angle bolt. Therefore, the strength of the connection is of utmost importance and should exceed that of the horizontal and the angle bolt. Moreover, the stresses may act in directions varying from horizontal. These variations result in stresses which must not exceed the strength of components.

The components of the mine roof truss of the present invention are capable of withstanding the stresses which would break the angle bolt or horizontal truss rods by a factor of one and one-half to one, and can be increased to match future increases deemed necessary.

It will be further noted from a consideration of the drawings that the coupling of the present mine roof truss is designed with a low profile, thereby leaving maximum unobstructed heights above the mine floor for operating mining machines.

While there has been herein shown and described the presently preferred form of this invention, it is to be understood that such has been done for purposes of illustration only, and that various changes may be made therein within the scope of the appended claims.

What is claimed is:

1. A mine roof support including (a) angularly disposed roof bolts, each having a shank and a head installed in spaced, opposed relationship in a mine passage;

(b) a truss member comprising a pair of truss rods extending between said roof bolts, said truss rods being initially unconnected;

(c) couplings for connecting the angularly disposed roof bolts to one end of each of said truss rods;

(d) each of said couplings comprising a housing having a first wall portion provided with a first opening through which the shank of the roof bolt passes;

(e) a first means within said housing engageable with the head of the roof bolt for securely holding the same;

(f) said housing having a second wall portion provided with an elongated vertical opening of substantially uniform width throughout its length;

(g) one end of each of said truss rods having a cross member at one end inserted through the elongated opening of said second wall portion for locking engagement with the latter, the length of said cross member being less than the length of said elongated opening, and the width of said cross member being less than the width of said elongated opening;

(h) a second means on the second wall portion of said housing for initially disposing the unconnected ends of said truss rods downwardly, and inwardly of the mine passage, to facilitate connection of the free ends of the truss rods together by an installer standing in the mine passage;

(i) a third means for securing the free ends of said truss rods together, and (j) a fourth means for tensioning said truss member.

2. The mine roof support of claim 1, wherein (a) said housing comprises a housing having a top wall, and side and end walls extending downwardly therefrom to form a cavity therebetween, and (b) said first means includes a seat extending transversely at an angle across the housing cavity between the top wall and the lower end of one of said housing end walls, for supporting the head of said bolt.

3. The mine roof support of claim 2, wherein (a) said seat is of concave shape, and provided with a central opening through which the shank of said bolt passes, and (b) a complemental washer having a convex outer surface mounted on the shank of the bolt adjacent the head thereof, for engagement with the concave surface of said seat, to permit adjustment of the roof bolt when the truss is installed on an uneven roof surface.

4. The mine roof support of claim 1, wherein (a) said second means comprises that portion of said second wall portion defining the lower limit of the elongated opening thereof, thereby providing a stop to limit the gravitational movement of the ends of the truss rods prior to connection thereof.

5. The mine roof support of claim 1, wherein (a) said second wall portion is of arcuate shape in the direction of the vertical, elongated opening between the upper and lower limits thereof, forming an inner surface of concave shape;

(b) the portion of the cross member of said truss rod engaging the concave inner surface of the second wall portion being of complemental convex shape, whereby said truss member is adjustably movable in a vertical plane to compensate for unevenness in the mine roof.

6. The mine roof support of claim 5, with the addition of (a) a flat roof plate interposed between said housing and the mine roof, and (b) a fifth means for connecting said roof plate to said housing.

7. The mine roof support of claim 6, wherein (a) said fifth means includes spaced lugs extending upwardly from said housing;

(b) said roof plate being provided with complemental recesses for receiving said lugs, to prevent accidental disengagement of said housing and roof plate.

8. A mine roof support including (a) angularly disposed roof bolts, each having a shank and a head installed in spaced, opposed relationship in a mine passage;

(b) a truss member comprising a pair of truss rods extending between said roof bolts, one end of each of which is provided with a cross member which extends beyond the end of the rod, thereby forming a rod end of T-shape configuration, said truss rods being initially unconnected;

(c) couplings for connecting the angularly disposed roof bolts to one end of each of said truss rods;

(d) each of said couplings comprising a housing having a top wall, and side and end walls extending downwardly therefrom to form a cavity therebetween;

(e) said top wall being provided with an opening which communicates with the cavity of the housing;

(f) a seat extending transversely at an angle across said cavity between the top wall and the lower end of one of said housing end walls;

(g) said head of the roof bolt being supported by said seat, and the shank thereof extending upwardly through the opening in said top wall into engagement with the mine roof;

(h) the other of said end walls being provided with an elongated vertical slot of uniform width throughout its length;

(i) the length of said cross member being slightly less than the length of the slot, and the width of said cross member being slightly less than the width of the slot, said cross member being inserted through the elongated slot and then rotated through approximately a 90° angle to effect locking engagement of the truss rod with the coupling;

(j) the lower limit of said elongated vertical slot being spaced from the lower limit of said end wall to provide a stop to limit the distance which the inner ends of the truss rods may gravitate when the outer ends of the truss rods are secured to the couplings, whereby said truss rods hang downwardly and inwardly towards each other to facilitate connection of the ends together, (k) a first means for securing the inner ends of said truss rods together, and (l) a second means for tensioning said truss member.

9. The mine roof support of claim 8, wherein (a) said other end wall is of arcuate conformation in the direction of the elongated vertical slot between the upper and lower limits thereof, forming an inner surface of concave shape;

(b) the portion of the cross member of said truss rod engaging the concave inner surface of said other wall being convex, whereby when the cross member is in locking engagement with said coupling, the inner surface of the cross member being in contiguous engagement with the concave surface of said other end wall, whereby said truss rod may be moved vertically with respect to said housing to compensate for unevenness in the mine roof.

10. The mine roof support of claim 9, with the addition of (a) a flat roof plate interposed between the mine roof and said housing, and (b) a third means for engaging said roof plate with said housing.

11. The mine roof support of claim 10, wherein (a) said third means comprises spaced recesses on one face of said roof plate, and (b) spaced lugs on the upper surface of said housing top wall engageable with the recesses of said roof plate, to prevent accidental displacement of the housing relative to the roof plate.

* * * * *